US006249667B1

(12) United States Patent
Acquaviva et al.

(10) Patent No.: US 6,249,667 B1
(45) Date of Patent: Jun. 19, 2001

(54) CONDITIONER ROLLS END SEALS

(75) Inventors: Thomas Acquaviva, Penfield; Alan G. Schlageter, Ontario, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/518,209

(22) Filed: Mar. 3, 2000

(51) Int. Cl.[7] ..... G03G 15/00
(52) U.S. Cl. ..... 399/406; 399/341
(58) Field of Search ..... 399/406, 237, 399/239, 249, 341; 118/246; 137/312

(56) References Cited

U.S. PATENT DOCUMENTS 5,264,899 11/1993 Mandel ..... 355/200
5,434,029 7/1995 Moser ..... 430/97
5,930,578 7/1999 Hwang ..... 399/406
6,011,947 * 1/2000 Acquaviva et al. ..... 399/406 X

* cited by examiner

*Primary Examiner*—Arthur T. Grimley
*Assistant Examiner*—Hoan Tran
(74) *Attorney, Agent, or Firm*—Linda M. Robb

(57) ABSTRACT

A paper conditioner to control image dependent curl in a copier/printer includes a reservoir for storing a quantity of liquid, a pair of rolls in contact with one another so as to define a nip, and a metering roll associated with the reservoir and one of the pair of rolls. The metering roll forms a nip with one of the pair of rolls to direct a controlled flow of liquid from the reservoir to the nip area. Seals located at opposed ends of the metering roll and the roll with which it forms a nip prevent the flow of excess liquid from the ends of the metering roll.

10 Claims, 3 Drawing Sheets

CONDITIONER ROLLS END SEALS

BACKGROUND OF THE INVENTION

This invention relates generally to a substrate conditioning device for an electrophotographic printing machine and, more particularly, concerns an improvement for eliminating water spills from the ends of moisturizing rolls in the conditioning device.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrophotographic printing machine. With the advent of multicolor electrophotography, it is desirable to use an architecture which comprises a plurality of image forming stations. One example of the plural image forming station architecture utilizes an image-on-image (IOI) system in which the photoreceptive member is recharged, imaged and developed for each color separation. This charging, imaging, developing and recharging, reimaging and developing, all followed by transfer to paper, is done in a single revolution of the photoreceptor in so-called single pass machines, while multipass architectures form each color separation with a single charge, image and develop, with separate transfer operations for each color. The single pass architecture offers a potential for high throughput.

In order to fix or fuse electroscopic toner material onto a support member by heat and pressure, it is necessary to apply pressure and elevate the temperature of the toner to a point at which the constituents of the toner material become tacky and coalesce. This action causes the toner to flow to some extent into the fibers or pores of the support medium (typically paper). Thereafter, as the toner material cools, solidification of the toner material occurs, causing the toner material to be bonded firmly to the support member. In both the xerographic as well as the electrographic recording arts, the use of thermal energy and pressure for fixing toner images onto a support member is old and well known.

One approach to heat and pressure fixing of electroscopic toner images onto a support has been to pass the support bearing the toner images between a pair of opposed roller members, at least one of which is internally heated. During operation of a fixing system of this type, the support member to which the toner images are electrostatically adhered is moved through the nip formed between the rolls and thereby heated under pressure. A large quantity of heat is applied to the toner and the copy sheet bearing the toner image. This heat evaporates much of the moisture contained in the sheet. The quantity of heat applied to the front and back sides of the sheet are often not equal. This causes different moisture evaporation from the two sides of the sheet and contributes to sheet curling. One solution to this problem is set forth in U.S. Pat. No. 5,434,029, discussed below, the contents of which are hereby incorporated by reference.

A number of solutions to this problem have been advanced. One proposed solution is to use an offset press dampening system to add moisture to each sheet as it exits the copier. These systems typically rely on the generation of a pool of water at a roll interface to distribute the water evenly along the rolls. Such systems usually operate with a web paper supply and their use with a cut sheet feeder system creates some difficulties not previously contemplated or addressed.

Another proposed solution is disclosed in U.S. Pat. No. 5,937,258, issued Aug. 10, 1999 to Thomas Acquaviva et al. and titled PAPER CONDITIONER WITH ARTICULATING BACK-UP/TRANSFER ROLLS, which is incorporated herein by reference to the extent necessary to practice the present invention. This solution uses a conditioner located after the fuser and before a mechanical decurler. The function of the conditioner is to replace the moisture lost in the fusing process and thereby reduce image dependent curl. The approach taken to replace moisture is to drive a sheet between two closely spaced rollers: one roller, called the back-up roller, is rubber coated and drives the sheet forward. The second roller, called the transfer roller, rotates in the opposite direction and applies a thin film of water to the paper on the side opposite to the back-up roller. The surface of the transfer roller is "wet" by passing through a flooded nip. The film thickness deposited on the transfer roll surface is determined by the pressure between the transfer roller and a metering roller. Two sets of these rollers are required to moisturize both sides of the sheet. One of the biggest problems is preventing water leakage from the system.

The following disclosures may be relevant to various aspects of the present invention:

U.S. Pat. No. 5,930,578 to Hwang discloses a paper conditioner to control image dependent curl in a copier/printer. The conditioner employs metering and transfer rolls which form a nip and have grooves positioned on the end portions of both rolls. Portions of both the metering and transfer rolls are located over a sump connected to a reservoir that supplies liquid to the nip. The grooves act as gutters and allow excess liquid to flow into the sump and subsequently back into the reservoir.

U.S. Pat. No. 5,434,029 to Moser describes an apparatus and method of preventing the curling of a substrate having toner images electrostatically adhered thereto which substrate has been subjected to heat for the purpose of fixing the toner images to the substrate. Simultaneous constraint of the copy substrate and the application of moisture thereto is effected by passing the substrate through the nip formed by two pressure engaged rollers, one of which is utilized for applying the water to the back side of the substrate as the substrate passes through the aforementioned nip.

U.S. Pat. No. 5,264,899 discloses a system for adding moisture to a copy sheet. The toner fixation step of electrostatographic reproduction desiccates paper, which may lead to the formation of a wave along the sheet edge. The invention uses a pair of porous rolls defining a nip to transfer additional moisture to the coy sheet as it is passed through the nip. The added moisture prevents edge wave formation.

SUMMARY OF THE INVENTION

In accordance with one aspect of the present invention, there is provided an apparatus for adding moisture to a sheet.

The device includes a reservoir for storing a quantity of liquid, a pair of rolls in contact with one another so as to define a nip between their outer surfaces, and a metering roll associated with the reservoir and one of the pair of rolls. The metering roll forms a nip with one of the pair of rolls to direct a controlled flow of liquid from the reservoir to the nip area. Seals located at the ends of the metering roll and the roll with which it forms a nip retain excess liquid in the nip.

In accordance with another aspect of the invention there is provided a printing machine, which includes a pair of rolls aligned with one another to define a nip. A metering roll is in circumferential surface contact with one of the cylindrical rolls to form a nip and control the amount of fluid supplied to the cylindrical roll. Seals, located at the ends of the metering roll and the roll with which it forms a nip, retain excess liquid in the nip.

BRIEF DESCRIPTION OF THE DRAWINGS

Other features of the present invention will become apparent as the following description proceeds and upon reference to the drawings, in which.

DETAILED DESCRIPTION OF THE INVENTION

This invention relates to an imaging system which is used to produce color output in a single revolution or pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system and a black and white printing system.

Figure 1:
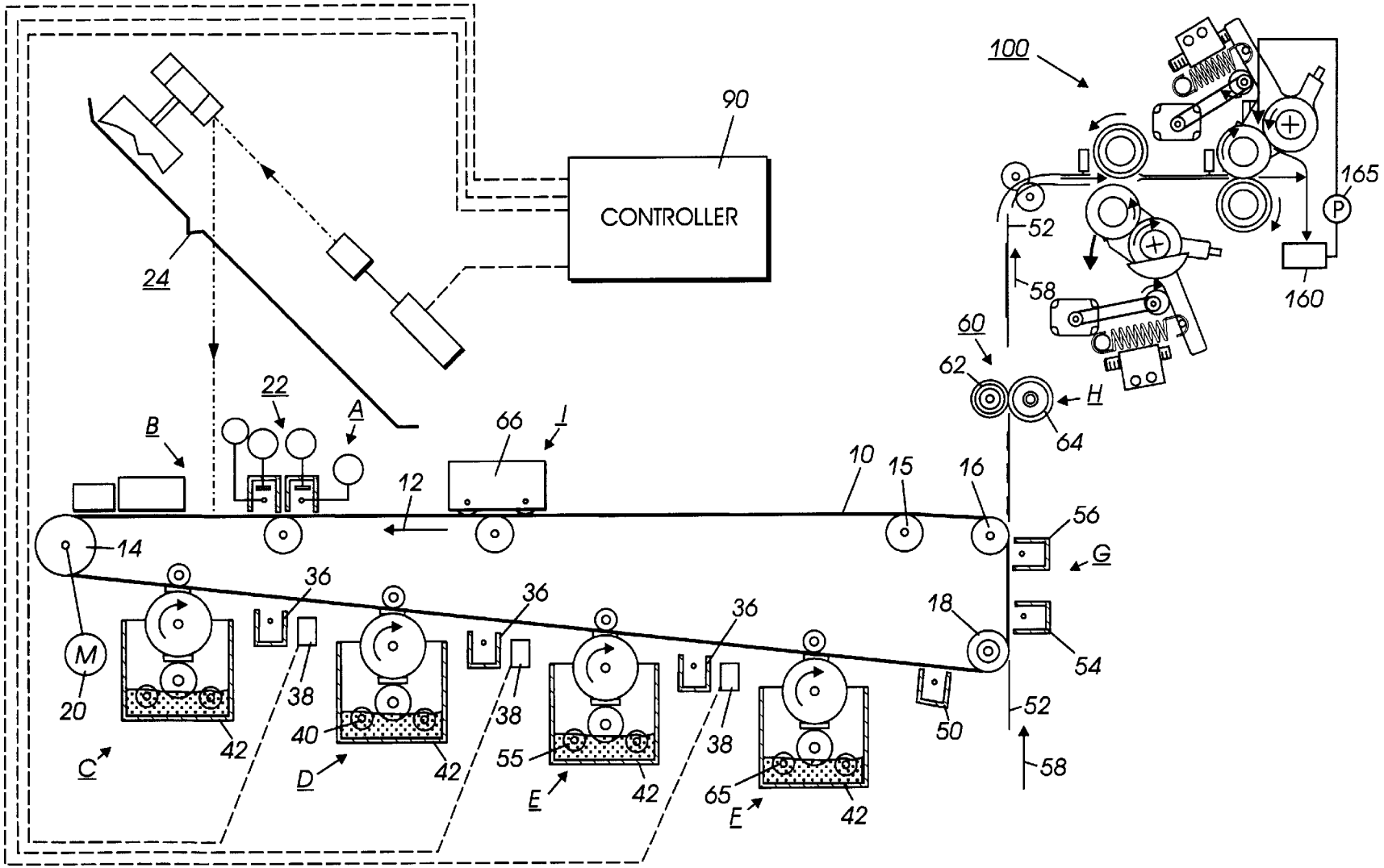
FIG. 1 is a schematic elevational view of a full color image-on-image single pass electrophotographic printing machine utilizing the apparatus described herein.

Turning now to FIG. 1, the printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14, tension rollers 16 and fixed roller 18 and the roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relatively high, substantially uniform, preferably negative potential.

Next, the charged portion of photoconductive surface is advanced through an imaging/exposure station B. At imaging/exposure station B, a controller, indicated generally by reference numeral 90, receives the image signals representing the desired output image and processes these signals to convert them to the various color separations of the image which is transmitted to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices such as LED arrays.

The photoreceptor, which is initially charged to a voltage $V_0$, undergoes dark decay to a level $V_{ddp}$ equal to about −500 volts. When exposed at the exposure station B it is discharged to $V_{expose}$ equal to about −50 volts. Thus after exposure, the photoreceptor contains a monopolar voltage profile of high and low voltages, the former corresponding to charged areas and the latter corresponding to discharged or background areas.

At a first development station C, developer structure, indicated generally by the reference numeral 42 utilizing a hybrid jumping development (HJD) system, the development roll, better known as the donor roll, is powered by two development fields (potentials across an air gap). The first field is the ac jumping field which is used for toner cloud generation. The second field is the dc development field which is used to control the amount of developed toner mass on the photoreceptor. The toner cloud causes charged toner particles to be attracted to the electrostatic latent image. Appropriate developer biasing is accomplished via a power supply. This type of system is a noncontact type in which only toner particles (black, for example) are attracted to the latent image and there is no mechanical contact between the photoreceptor and a toner delivery device to disturb a previously developed, but unfixed, image.

A corona recharge device 36 having a high output current vs. control surface voltage (I/V) characteristic slope is employed for raising the voltage level of both the toned and untoned areas on the photoreceptor to a substantially uniform level. The recharging device 36 serves to recharge the photoreceptor to a predetermined level.

A second exposure/imaging device 38 which comprises a laser based output structure is utilized for selectively discharging the photoreceptor on toned areas and/or bare areas, pursuant to the image to be developed with the second color toner. At this point, the photoreceptor contains toned and untoned areas at relatively high voltage levels and toned and untoned areas at relatively low voltage levels. These low voltage areas represent image areas, which are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by way of a second HJD developer system. A power supply (not shown) serves to electrically bias the developer structure to a level effective to develop the discharged image areas with negatively charged yellow toner particles 40.

The above procedure is repeated for a third imager for a third suitable color toner such as magenta and for a fourth imager and suitable color toner such as cyan. The exposure control scheme described below may be utilized for these subsequent imaging steps. In this manner a full color composite toner image is developed on the photoreceptor belt.

To the extent to which some toner charge is totally neutralized, or the polarity reversed, thereby causing the composite image developed on the photoreceptor to consist of both positive and negative toner, a negative pre-transfer dicorotron member 50 is provided to condition the toner for effective transfer to a substrate using positive corona discharge.

Subsequent to image development, a sheet of support material 52 is moved into contact with the toner images at transfer station G. The sheet of support material is advanced to transfer station G by conventional sheet feeding apparatus, not shown. Preferably, the sheet feeding apparatus includes a feed roll contacting the uppermost sheet of a stack copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52. After fusing, a chute, not shown, guides the advancing sheets 52 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush structure contained in a housing 66.

It is believed that the foregoing description is sufficient for the purposes of the present application to illustrate the general operation of a color printing machine.

Figure 2:
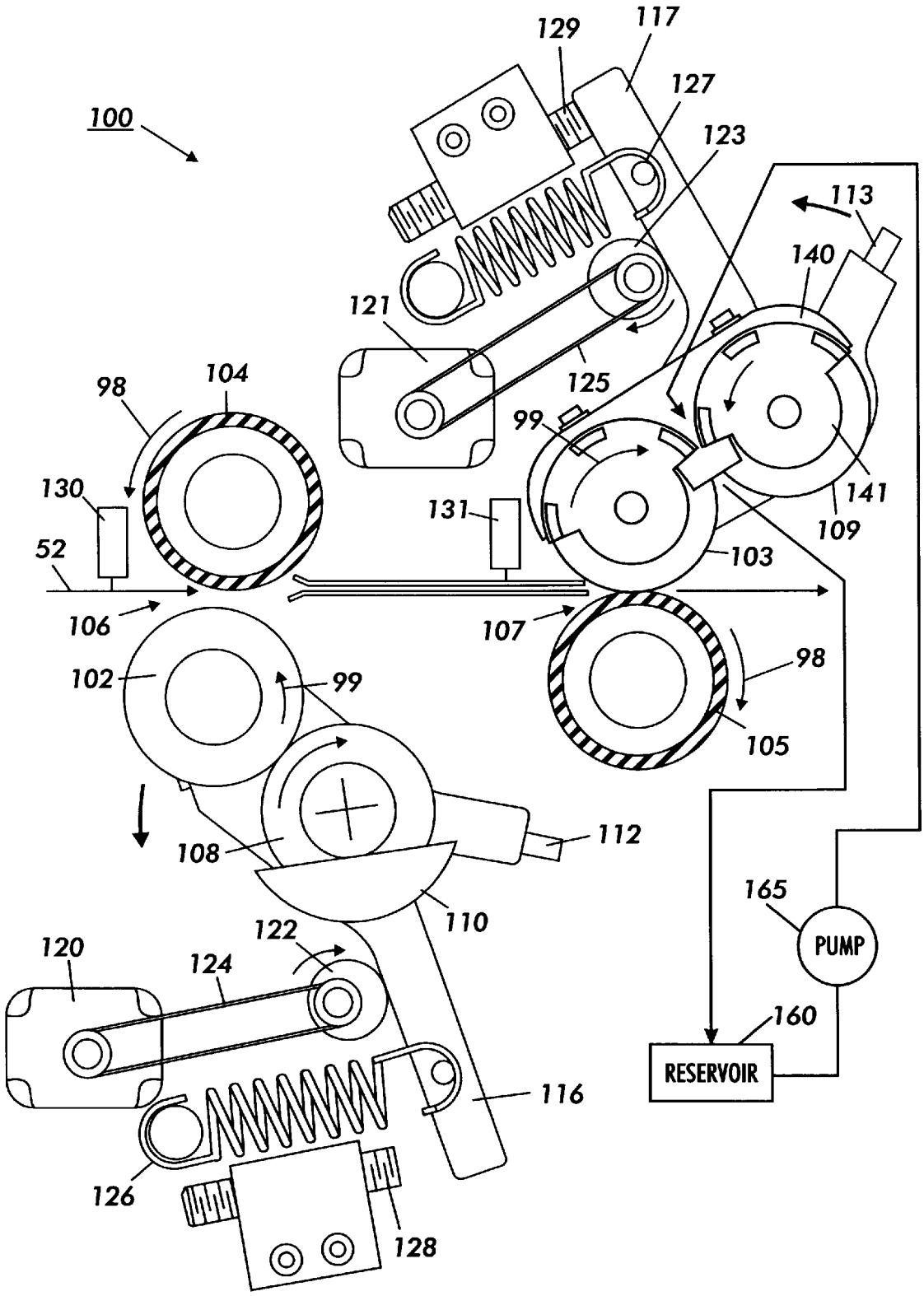
FIG. 2 is a detailed elevational side view of the paper conditioning apparatus.

As shown in FIG. 2, the sheet conditioning device, generally referred to as reference numeral 100, has transfer rollers 102, 103 which are articulated in an almost vertical direction, such that when the lead edge of incoming sheets 52 enter the nip areas 106, 107, the transfer rollers 102, 103 move towards the sheet 52 to approach the rotating back-up rollers 104, 105 which are in a fixed position. Transfer roll 102 and backup roll 104 are adapted to rotate in the direction of arrows 99 and 98, respectively. Likewise, when the trail edge of the sheet is about to exit the nips 106, 107, the transfer rollers 102, 103 move away from the sheet 52 to disengage the back-up rollers 104, 105. Springs 126, 127 provide the normal force for the transfer rollers 102, 103 against back up rollers 104, 105. Since the back-up rollers 104, 105 are rubber coated, a thick or thin sheet will deflect the rubber surface and provide the necessary drive force. The roller nips 106, 107 are disengaged in the intercopy gap, by say 0.015", and there is no danger that the back-up rollers 104, 105 will be wet.

The wetting agent, in this case water, is distributed to transfer roller 102 from sump 110 by way of metering roll 108. Water from reservoir 160, by way of pump 165 is added directly to transfer roller 103 and metering roller 109 by any known means, for example a tube, to accumulate in nip 111, formed between rollers 103 and 109. The contact between the metering rolls 108, 109 and the transfer rolls 102, 103 can be adjusted by using adjuster screws 112, 113 which can be manually adjusted as shown, or the adjusters 112, 113 can be driven by a motor (not shown) or other device to provide automatic adjustment depending on the desired film thickness on the transfer roller. The upper transfer roll 103/metering roll 109 assembly must be modified so that the wetting agent is prevented from dripping onto the sheet and producing undesirable wetting characteristics. This is accomplished by utilizing the seal of the instant invention, discussed below, in combination with the upper metering roll 109 to provide a flooded nip. The amount of moisture added to a sheet is a function of the relative velocity between the sheet 52 and the transfer rollers 102, 103, which transfer rollers 102, 103 are rotated in a direction opposite to the direction of the sheet as indicated by arrows 99.

A sensor 130 located upstream of the first moisturizing nip 106, detects lead and trail edge sheet position and provides the necessary timing to decrease and increase the nips 106, 107. For example, if the sheet velocity when it is at the sensor 130, and the distance from the sensor 130 to each moisturizing nip 106, 107 are known, and the velocity between nips and sheet velocity in each nip is known, then it is a relatively simple algorithm to determine when to engage and disengage each nip. Alternately, a second sensor 131 can be used between the nips 106, 107 to assist in determining the proper sequencing of the second nip engagement/disengagement.

There is illustrated only one of many methods of separating the nips 106, 107. In FIG. 2, there is shown two stepper motors 120, 121 driving two cams 122, 123. As each cam 122, 123 rotates in the clockwise direction, it separates the respective transfer roller 102, 103 from the respective back-up roller 104, 105. In the position illustrated by the cam 122, the nip 106 may be separated by 0.015". When the cams are in the position illustrated by cam 123, the cam surface is not touching the pivot arm 117, but the contact dimension is determined by the adjustment screw 129. A similar screw 128 is provided for arm 116. This scheme uses two stepper motors 120, 121 driving cams 122, 123 through drive members 124, 125. Alternate methods might employ solenoids, clutches, cables etc. Likewise, alternate methods might articulate the back-up rollers 104, 105 instead of the transfer rollers 102, 103.

Figure 3:
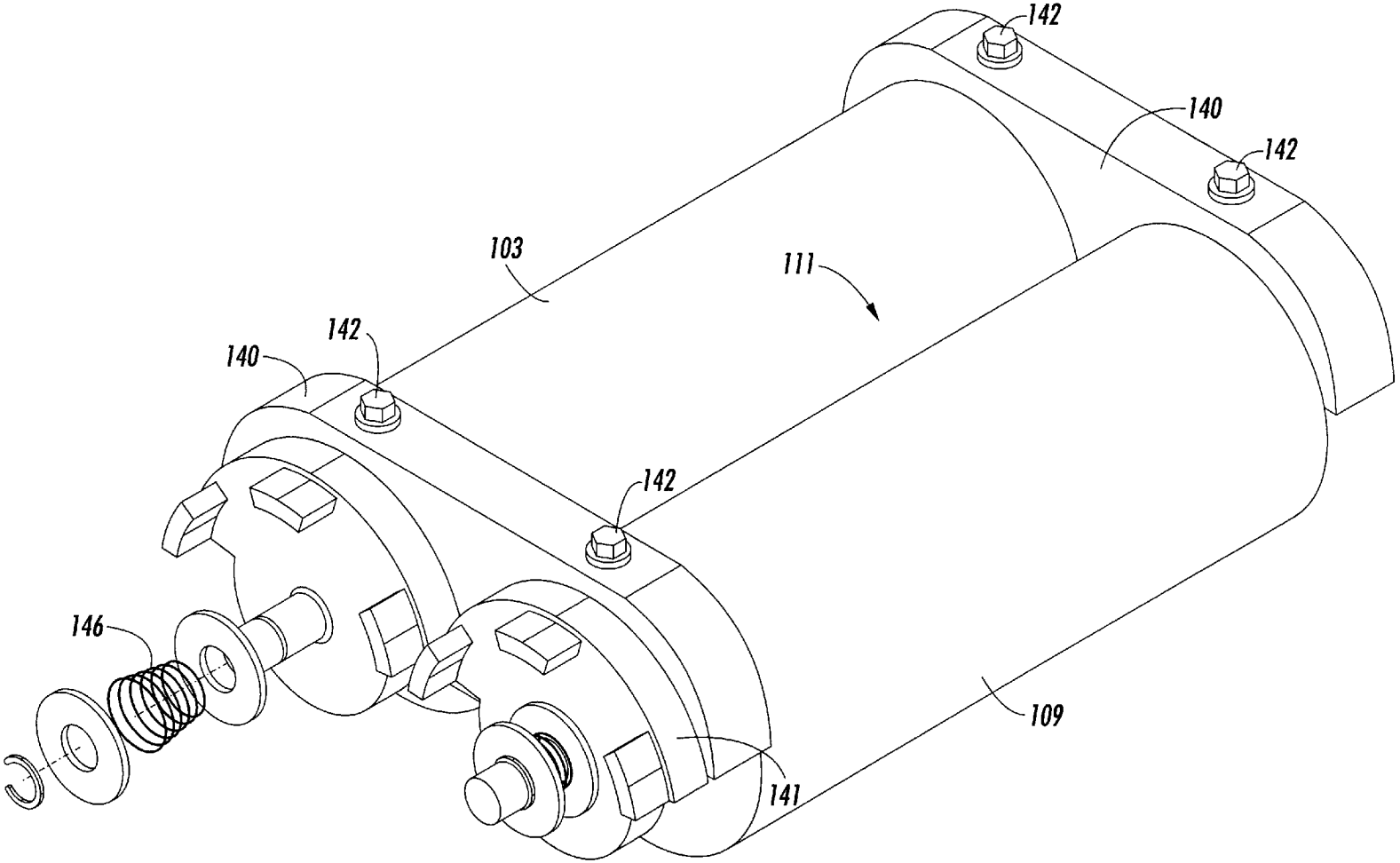
FIG. 3 is a detailed partial top view of the paper conditioning apparatus of FIG. 2 showing the end seals in accordance with the present invention.

Referring now to FIG. 3, in accordance with the present invention, an improved wetting agent leakage prevention system is shown employed with the upper transfer roll 103/metering roll 109 assembly to insure that the wetting agent is prevented from dripping onto the sheet and producing undesirable wetting characteristics. The wetting agent leakage prevention system includes a sealing pad 140, preferably made of Teflon® or any other suitable material, pressed against the ends of the metering and transfer rolls. In the preferred embodiment, the sealing pad is undercut around the inside core area of the rolls to reduce wear and drag against the ends of the rollers. The sealing pad creates a seal by contacting the rubber sleeve of the metering roller and the core of the upper transfer roller. Metal blocks 141 lock the sealing pad in place around each roller shaft and are connected to the sealing pad by fasteners 142. For removal and replacement of the sealing pad, the fasteners 142 are moved and the metal blocks are rotated away from the sealing pad. A worn sealing pad then can be removed from the unit and replaced. Conical springs 146 load the sealing pad 140 against the roller ends through pressure applied to the metal blocks. Although conical springs provide pressure to the sealing pad in the preferred embodiment, it is readily apparent that numerous alternative methods could be successfully employed.

In recapitulation, there is provided a paper conditioner that provides sealing pads on the ends of the metering and transfer rolls to prevent wetting agent leakage from the ends of the roller nips. The sealing pads are spring-loaded against the ends of the metering and transfer rolls with sufficient pressure to prevent leakage but not introduce excessive drag into the system. Metal blocks lock the sealing pads in place and may be rotated away from the sealing pads for replacement of the pads.

It is, therefore, apparent that there has been provided in accordance with the present invention, a paper conditioning device that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for adding moisture to a sheet while simultaneously controlling leakage of liquid therefrom, comprising:

a reservoir for storing a liquid;

a pair of rolls in contact with one another to define a nip therebetween;

a metering roll, associated with said reservoir and contacting one of said pair of rolls and forming a nip therebetween for directing a controlled flow of liquid from said reservoir to said one roll of said pair of rolls; and a seal located at opposed ends of said metering roll and said one of said pair of rolls for preventing the flow of excess liquid from the ends of said metering roll and said one of said pair of rolls, wherein said seal comprises a pad contacting said metering roll and said one of said pair of rolls.

2. An apparatus according to claim 1, further comprising means for holding said seals in pressing and sliding engagement with said metering roll and said one of said pair of rolls.

3. An apparatus according to claim 2, further comprising means for securing said seals in place against said holding means.

4. An apparatus according to claim 2, wherein said holding means removably secures said seal.

5. An apparatus according to claim 2, further comprising a spring for pressing said holding means and said seal against said metering roll and said one of said pair of rolls in sealing engagement.

6. A printing machine of the type wherein a sheet having indica printed thereon advances through a conditioning system, said conditioning system comprising:

a reservoir for storing a liquid;

a pair of rolls in contact with one another to define a nip therebetween:

a metering roll associated with said reservoir and contacting one of said pair of rolls and forming a nip therebetween for directing a controlled flow of liquid from said reservoir to one roll of said pair of rolls; and a seal located at opposed ends of said metering roll and said one of said pair of rolls for preventing the flow of excess liquid from the opposed ends of said metering roll and said one of said pair of rolls, wherein said seal comprises a pad contacting said metering roll and said one of said pair of rolls.

7. The printing machine according to claim 6, further comprising means for holding said seals in pressing and sliding engagement with said metering roll and said one of said pair of rolls.

8. The printing machine according to claim 7, further comprising means for securing said seals in place against said holding means.

9. The printing machine according to claim 7, wherein said holding means removably secures said seal.

10. The printing machine according to claim 7, further comprising a spring for pressing said holding means and said seal against said metering roll and said one of said pair of rolls in sealing engagement.

* * * * *